US005623721A

United States Patent [19]

Lindblad et al.

[11] Patent Number: 5,623,721

[45] Date of Patent: Apr. 22, 1997

[54] BRUSH BIAS POLARITY FOR DUAL ESB CLEANERS WITHOUT PRECLEAN COROTRON FOR TRIBOELETRIC NEGATIVE TONERS

[75] Inventors: Nero R. Lindblad, Ontario; Christopher W. Curry, Rochester, both of N.Y.

[73] Assignee: Xerox Corportion, Stamford, Conn.

[21] Appl. No.: 622,980

[22] Filed: Mar. 27, 1996

[51] Int. Cl.[6] ..... G03G 21/00

[52] U.S. Cl. ..... 399/354

[58] Field of Search ..... 355/297, 303, 355/301, 296; 399/354

[56] References Cited

U.S. PATENT DOCUMENTS

| | | | |
|---|---|---|---|
| 4,545,669 | 10/1985 | Hays et al. | 355/253 |
| 4,999,679 | 3/1991 | Corbin et al. | 355/303 |
| 5,151,744 | 9/1992 | Lundy et al. | 355/296 |
| 5,233,398 | 8/1993 | Nimura et al. | 355/301 |
| 5,257,079 | 10/1993 | Lange et al. | 355/303 |
| 5,416,572 | 5/1995 | Kolb et al. | 355/299 |
| 5,519,480 | 5/1996 | Thayer et al. | 355/301 |

FOREIGN PATENT DOCUMENTS

| | | |
|---|---|---|
| 59-147374 | 8/1984 | Japan . |
| 61-107369 | 5/1986 | Japan . |
| 4-51168 | 2/1992 | Japan . |
| 4-80781 | 3/1992 | Japan . |

*Primary Examiner*—Nestor R. Ramirez
*Attorney, Agent, or Firm*—T. L. Fair

[57] ABSTRACT

An apparatus and method for cleaning triboelectric negative toner particles from the photoreceptor surface without the need of a preclean corotron. To remove the residual particles, a first cleaning brush, in the direction of motion of the photoreceptor, is negatively biased to remove the positive (+) toner and charge the toner particles negative. Then, the second brush, in the direction of motion of the photoreceptor, is positively biased to remove the residual negative toner particles from the surface as the second brush contacts the surface.

9 Claims, 4 Drawing Sheets

BRUSH BIAS POLARITY FOR DUAL ESB CLEANERS WITHOUT PRECLEAN COROTRON FOR TRIBOELETRIC NEGATIVE TONERS

CROSS REFERENCE

Cross reference is made to and priority is claimed from copending U.S. patent application Ser. No. 08/622,978 entitled "Correct Brush Bias Polarity for Single and Dual ESB Cleaners with Triboelectric Negative Toners" by N. R. Lindblad et al., assigned to the same assignee as the present invention.

BACKGROUND OF THE INVENTION

This invention relates to an electrostatographic printer or copier, and more particularly concerns a cleaning apparatus and method for cleaning triboelectric negative toner without the use of a preclean corotron.

For DAD (Discharge Area Development) and image quality, triboelectric negative toners are being used with greater frequency in electrostatographic printers and copiers. These toners are designed to be triboelectric negative, inherently, and charge negatively with a positive developer carrier. This triboelectric negative charge of the toner particles affects effective cleaning of these particles from the imaging surface.

The following disclosures may be relevant to various aspects of the present invention and may be briefly summarized as follows:

U.S. Pat. No. 5,257,079 to Lange et al. discloses a cleaning brush electrically biased with an alternating current removes discharged particles from an imaging surface. The particles on the imaging surface are discharged by a corona generating device. A second cleaning device including an insulative brush, a conductive brush or a blade, located upstream of the first mentioned brush, in the direction of movement of the imaging surface, further removes redeposited particles therefrom.

U.S. Pat. No. 4,545,669 to Hays et al. discloses an apparatus for simultaneously charging, exposing, and developing imaging numbers at low voltages which comprises a semi-transparent deflected flexible imaging member, an electronic imaging source means, a light beam deflector member, a means, containing magnets therein, a development roll means containing magnets therein, a voltage source means for sensitizing roll means, a voltage source for the development roll means, a developer supply reservoir containing conductive developer particles therein comprised of insulating toner resin particles and conductive carrier particles, a sensitizing nip situated between the flexible imaging member and the sensitizing roll, a development nip situated between the imaging member and the development roller, the sensitizing roll means and development roll means moving in the same direction o movement as the semi-transparent deflected flexible imaging member, the voltage being generated by the voltage source with the sensitizing nip being of an opposite polarity of the voltage generated by the voltage source for the development roller, wherein an electric field of a predetermined polarity is established between the semi-transparent deflected flexible imaging member ant the sensitizing roll means, which field exert in the sensitizing roll means, which field exerts in the sensitizing nip an electrostatic force on the charged toner particles causing these particles to uniformly migrate toward the imaging member, subsequently subjecting the deflected flexible imaging member to the electronic image source whereby the electrostatic force exerted on the toner particles adjacent the light struck areas of the flexible imaging member are increased thereby causing toner particles to be deposited on the deflected flexible imaging member, and wherein toner particles are removed from the deflected flexible imaging member in areas not exposed to light by the development roll and developed in the areas exposed to light.

SUMMARY OF INVENTION

Briefly stated, and in accordance with one aspect of the present invention, there is provided an apparatus for removing triboelectric negatively charged particles from a surface, the surface being capable of movement, comprising: a first means of cleaning having a first bias; a second means of cleaning having a second bias, the second cleaning means being located downstream from the first means in a direction of motion of the surface; and a housing, the first cleaning means and the second cleaning means being partially enclosed therein.

Pursuant to another aspect of the present invention, there is provided a method for cleaning negative triboelectrically charged particles from a surface having movement, comprising: transferring an image to a print media; charging a first brush, negatively, to remove positively charged residual particles and increase negative charge to negatively charged residual particles as the first brush contacts the surface; and charging a second brush, located downstream from the first brush in a direction of motion of the surface, positively, to remove the negatively charged residual particles from the surface as the second brush contacts the surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 14:
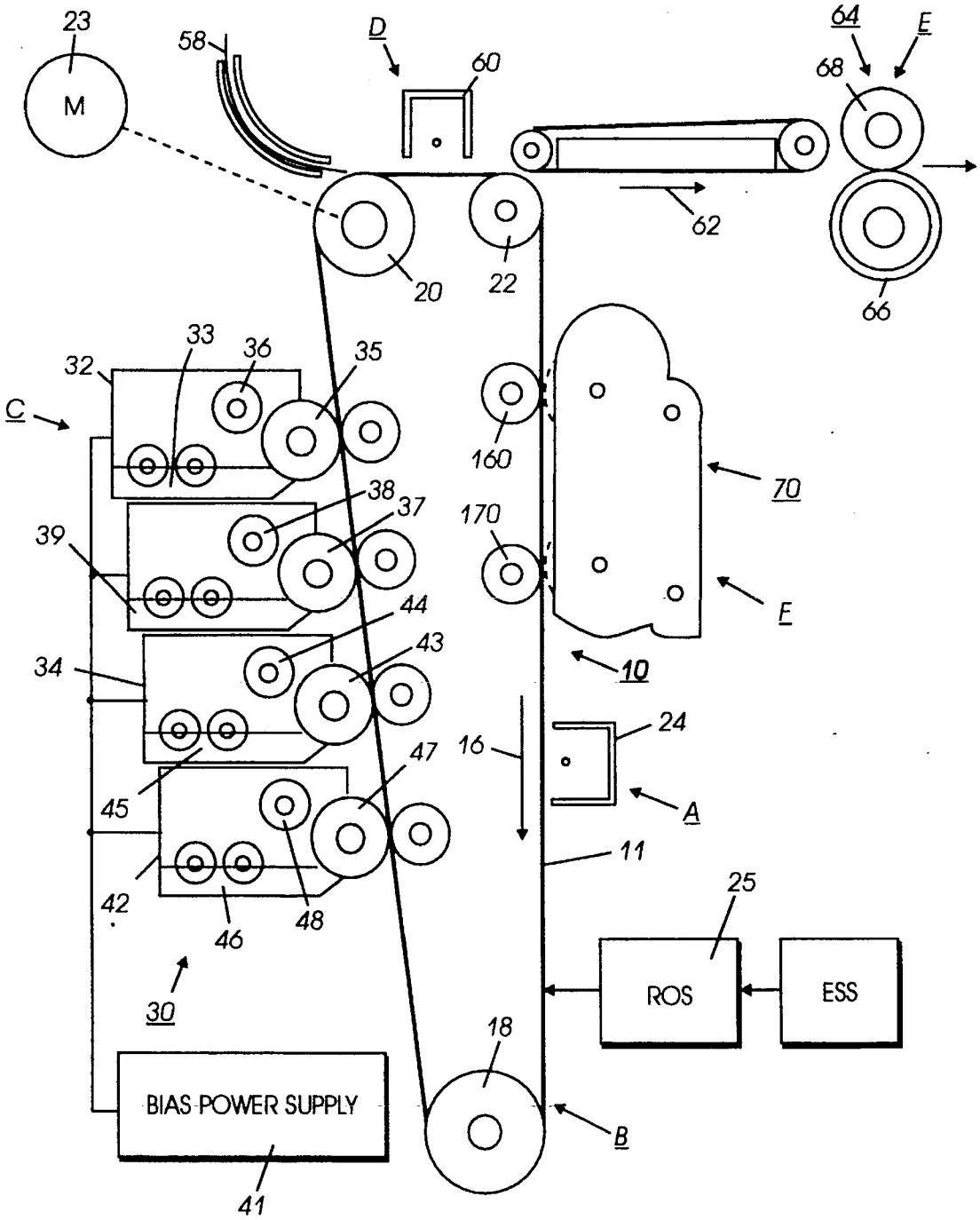
FIG. 14 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 14 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement pass charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 14, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. -All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet. After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush or other type of cleaning system 70. The cleaning system is supported under the photoreceptive belt by two backers 160 and 170.

In the present invention, a preclean treatment is not required after transfer when the brush polarity for a DESB (i.e. Dual Electrostatic Brush) is negative (–) / positive (+), i.e., when the first brush, in the direction of motion of the photoreceptor, is biased negative, and the second brush is biased positive. In the present invention, after removing the positively charged residual toner particles, the remaining particles are more negatively charged for efficient cleaning by the second positively biased brush. In the present invention, the negative charging of the toner by the first brush is referred to as the charge injection phenomenon.

Lab experimentation has shown that a (±) brush bias polarity effectively cleans transferred toner charge distributions. The typical toner mass density after transfer is approximately 0.05 mg/cm$^2$. In lab experiments, toner mass densities up to 0.7 mg/cm$^2$ have been cleaned, which is a marked increase in toner mass density that can be cleaned from a photoreceptor without a preclean treatment. And, it has been determined that even higher toner mass densities can be cleaned by simply increasing the brush rpm or increasing the weave density of the brush, i.e. the number of brush fiber strikes on the toner particles. Thus, as in the present invention, when the toner particles are naturally triboelectrically negative, a DESB cleaner with a (±) brush bias polarity can be used to clean triboelectric negative toners without a preclean corotron.

Figure 1:
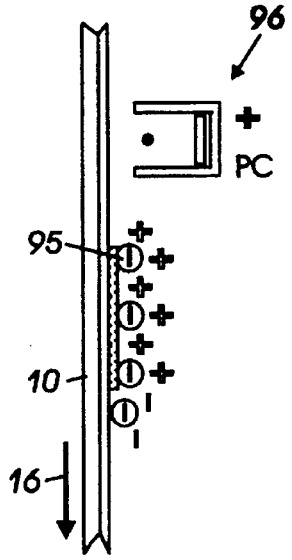
FIG. 1 is a schematic illustration showing the first step of an experiment to illustrate the charge injection phenomenon.
Figure 2:
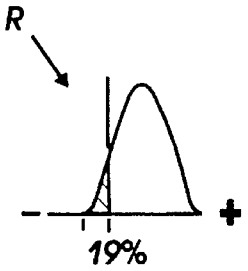
FIG. 2 is a graphical illustration of the toner charge distribution shown in FIG. 1.
Figure 3:
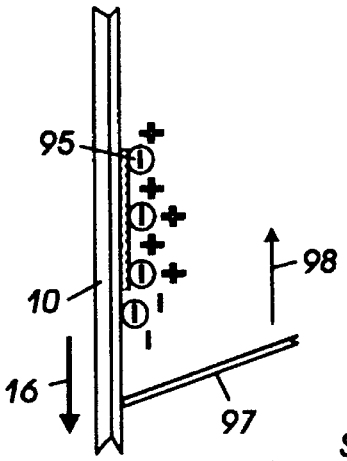
FIG. 3 is a schematic illustration of the second step of the experiment illustrating charge injection.
Figure 4:
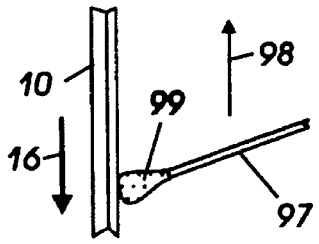
FIG. 4 is a schematic illustration of the third step of the experiment illustrating charge injection.

To show how the present invention, using charge injection, effectively cleans without a preclean corotron, the following description of lab experiments used to determine the preferred brush polarity to effectively clean the charge distribution of the residual toner is provided. FIGS. 1, 3 and 4 show a simple three step experiment that reveals the charge injection phenomenon and the preferred brush polarity. Reference is now made to FIG. 1, which schematically illustrates the first step in the experiment to show the charge injection phenomenon. First the triboelectric negative toner 95 is charged positively with a positive preclean corotron 96. This toner charge distribution is shown graphically in FIG. 2. The small hatch-marked portion R of the distribution illustrates the amount of negative charge on the toner particles 95 present after the (+) preclean treatment shown in FIG. 1. The triboelectric negative toner 95 is predominantly charged positive by the positive preclean corotron 96.

Reference is now made to FIG. 3 which shows schematically step two of the experiment. A thin conductive wire was used to simulate a conductive brush fiber. (However, it is noted that any conductive element that provides a negative charge, including a negatively charged conductive blade can be used in the present invention). The wire 97 was biased with −250 volts, and pulled through the positively charged toner image, in the direction of arrow 98. If charge injection occurred, the toner match head 99 (see FIG. 4) developed on the wire 97 would become more negative toner.

Figure 5:
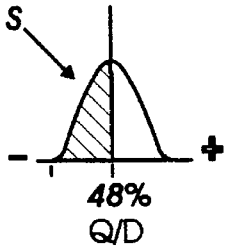
FIG. 5 is a graphical illustration of the toner charge distribution shown in FIG. 4.

Reference is now made to FIG. 4, which shows the final step of this lab experiment. The toner charge distribution on the wire 97 was measured and is shown in FIG. 5. It is apparent from the hatched-marked region S on the negative side of the graph shown in FIG. 5, that there is more negatively charged toner after step two. The negative toner charge increased from about 19% in step one to about 48% in step three, as shown in FIG. 5. This increase in negative toner charge is also apparent in the Q/D range shown in FIG. 5, where Q is the charge on the particles and D is the diameter of a particle. In FIG. 5, the toner charge distribution is the distribution of charge on a toner material determined by the charge-to-diameter ratio for each size particle in the toner material. This is referred to as a charge spectrograph.

Thus, this experiment showed that the negative wire 97 (in this case) injected charge into the toner when the wire 97 contacted the toner. A second experiment further shows that the negative wire, or other negatively charged device, injects charge into the toner particles when it contacts the toner particles.

Figure 6:
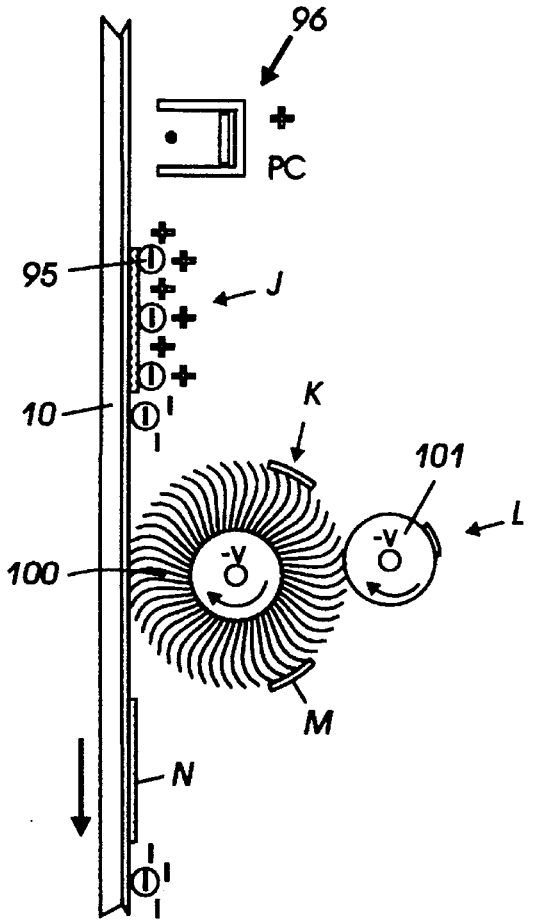
FIG. 6 is a schematic illustration of charge injection phenomenon using a brush cleaner.
Figure 7:
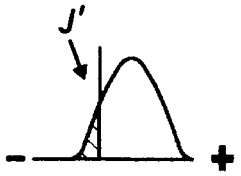
FIGS. 7–10 show graphical illustrations of the toner charge distribution of negative triboelectric toner at different steps in the cleaning operation of FIG. 6.
Figure 8:
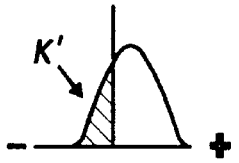
Figure 9:
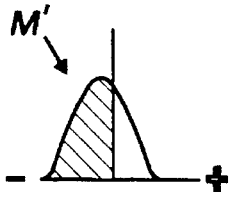
Figure 10:
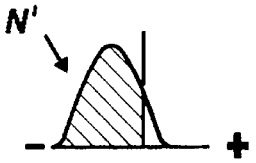

The second experiment shows the charge distribution measurements made on a negatively biased brush cleaning toner off the photoreceptor. FIG. 6 is a schematic illustration that shows the charge injection phenomenon when the brush cleans the toner off the photoreceptor, and when the detoning roll removes the toner from the brush. In this case, the charge injection creates a redeposition failure N on the photoreceptor. FIGS. 7–10 show the charge distributions measured from the brush 100 and the photoreceptor 10. After the preclean treatment 96, the toner charge distribution is shown in FIG. 7. As shown by FIG. 7, after the positive preclean there is a small amount of negative toner shown by the hatched-marked area labeled J'. Most of the toner shown by the patch of toner J in FIG. 6 is cleaned off the photoreceptor 10 by the negatively biased brush 100. This is illustrated on the brush 100 by the curved patch K; (i.e. this is actually a patch of toner on the brush 100). The charge distribution for this toner patch K is shown in FIG. 8. It is already apparent that some charge injection has occurred because the charge distribution is more negative as shown by the hatched-marked area K'. As the brush rotates a portion of the patch K is detoned by the detoning roll 101. The portion of the patch detoned is shown by patch L in FIG. 6. The detoning roll 101 is biased more negatively than the brush 100 for detoning. The remaining toner on the brush after detoning is labeled M. The corresponding toner charge distribution for this patch is shown in FIG. 9, with the negative portion indicated by the hatched marked area M'. Again, the toner charge increased in negativity, making the M patch more negative then the K patch. Since the brush is biased negative, the negative toner in the M patch is repelled off the brush 100 onto the photoreceptor 10 to create the redeposition toner patch failure labeled N. The charge distribution for this redeposition toner N has even more negative charge as shown by the charge distribution of N'. Further showing that the negatively charged brush 100, and the negatively charged detoning roll 101 are injecting negative charge into the negative triboelectric toner.

Figure 11:
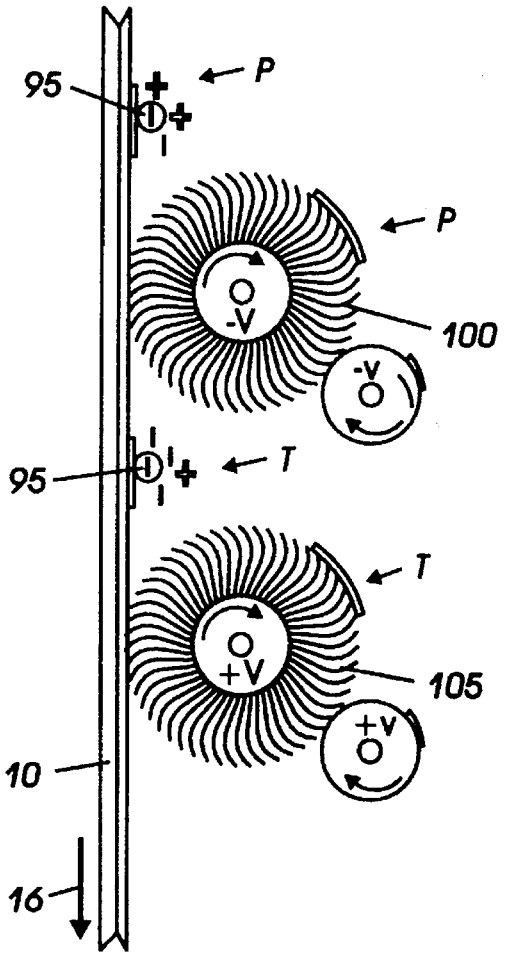
FIG. 11 shows a schematic illustration of the present cleaning invention for negative triboelectric toner without a preclean corotron.
Figure 12:
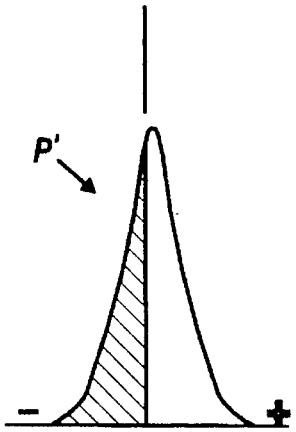
FIG. 12 shows a bipolar charge distribution of the toner patch P, on the photoreceptor after transfer.
Figure 13:
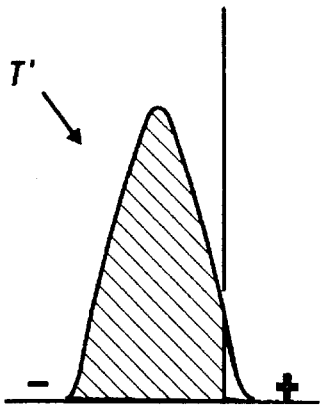
FIG. 13 shows a charge distribution of toner patch T, on the photoreceptor, that passed under the negatively biased cleaner brush.

FIG. 11 shows an image type of failure, caused by charge injection, that can occur with a dual electrostatic brush in a printer or copier. After transfer, the toner charge distribution is close to being bipolar as shown in FIG. 12. The hatched-marked region, P', is the negative portion of the charge distribution. In the present invention, a negatively charged brush 100 is used to clean the triboelectrically negative toner 95 from the photoreceptor 10. A portion (labeled P) of the image is collected on the brush 100, and a portion (labeled T) is left on the photoreceptor 10 after cleaning by the negatively biased brush 100. (T is the portion of the toner that passes under the brush 100 and corresponds to an image failure and redeposited toner from the brush.) The toner portion T left on the photoreceptor 10 is more negative than the input toner P. The toner charge distribution of T is shown in FIG. 13, and the hatched- marked area labeled T' is the negative portion of the distribution. To clean the toner patch T, a positively biased brush 105 is used as the secondary cleaner, in the direction of motion of the photoreceptor. Even though this toner patch T has some positive charge, the positively charged brush 105 removes the toner patch T. It has been shown experimentally that a positively charged brush will clean a triboelectric negative toner charge distribution that has Q/D±1.7 to +0.45 fc/micron at about 18 fiber strikes. And, if the number of fiber strikes are increased on the toner particles the brush will clean even more positive toner. There is always an affinity between a positive brush and negative triboelectric toner even if the toner particles have some 'real' positive charge.

in the present invention, the fact that a negatively biased cleaner followed by a positively biased cleaner, in the direction of motion of the imaging surface, works without a preclean treatment is because the first negatively biased cleaner removes the positive portion of the residual particles on the imaging surface and injects a charge into the remaining particles on the surface, making the residual particles more negative. Thus, the second positively biased cleaner has the correct polarity for removal of this portion of T toner. In fact, the present invention has experimentally stressed the cleaner by increasing toner mass density and the negative charge of the input toner making it more difficult to clean P. Thus the residual T toner has a higher mass density and a higher negative charge. However, in the present invention, the second positively charged cleaner still cleaned the T toner because this T toner has the correct charge. Thus, in the present invention, the charge injection phenomena that occurs with a negative biased cleaning brush and negative triboelectric toner makes it possible to operate a dual ESB cleaner without any preclean treatment.

In recapitulation, the present invention utilizes charging injection phenomenon to assist in cleaning the photoreceptor surface without a preclean by oppositely biasing the two cleaners (e.g. brushes). The triboelectrically charged toner particles are negatively charged. To remove the residual particles a first cleaning brush, in the direction of motion of the surface, is negatively biased to remove the positive (+) toner and further charge the negative particles. Then, the second brush is positively biased to enable attraction and removal of the residual negative toner (–) particles from the surface as the second brush contacts the surface. Furthermore, the present invention reduces cost by eliminating the need for a preclean corotron.

It is, therefore, apparent that there has been provided in accordance with the present invention, opposite biasing of the dual electrostatic brushes without the use of a preclean corotron for negatively charged triboelectric toner that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing triboelectric negatively charged particles from a surface, the surface being capable of movement, comprising:

a first means of cleaning having a first bias for removing particles from the surface, the particles being positively and negatively charged;

a second means of cleaning having a second bias for removing particles from the surface, the particles being positively and negatively charged, said second cleaning means being located downstream from said first means in a direction of motion of the surface;

said first cleaning means having the first bias and said second cleaning means having the second bias opposite the first bias, said first and second cleaning means removing positively charged particles having remaining particles negatively charged;

the first bias of said first cleaning means further negatively charging the remaining particles comprising a charge injection phenomenon, said charge injection phenomenon enabling the second bias of said second cleaning means to efficiently remove the remaining particles from the surface; and a housing, said first cleaning means and said second cleaning means being partially enclosed therein.

2. An apparatus as recited in claim 1, wherein said first cleaning means comprises a first brush.

3. An apparatus as recited in claim 2, wherein said second cleaning means comprises a second brush.

4. An apparatus as recited in claim 3, wherein said first brush is electrostatic.

5. An apparatus as recited in claim 4, wherein said second brush is electrostatic.

6. An apparatus as recited in claim 5, wherein said first brush having a bias applied thereto being opposite a bias being applied to said second brush.

7. An apparatus as recited in claim 6, wherein said first brush being biased negatively.

8. An apparatus as recited in claim 7, wherein said second brush being biased positively.

9. A method for cleaning negative triboelectrically charged particles from a surface having movement, comprising:

transferring an image to a print media;

charging a first brush negatively to remove positively charged residual particles and increase negative charge to negatively charged residual particles creating a charge injection phenomenon, as the first brush contacts the surface; and charging a second brush, located downstream from the first brush in a direction of motion of the surface, positively, to remove the negatively charged residual particles from the surface as the second brush contacts the surface.

* * * * *